United States Patent [19]

Seely

[11] Patent Number: 4,592,158

[45] Date of Patent: Jun. 3, 1986

[54] ROLL-UP SIGN WITH ATTACHMENT STRIPS

[75] Inventor: James R. Seely, Farmington, Conn.

[73] Assignee: Marketing Displays, Inc., Farmington Hills, Mich.

[21] Appl. No.: 688,067

[22] Filed: Dec. 31, 1984

Related U.S. Application Data

[63] Continuation-in-part of Ser. No. 623,622, Jun. 22, 1984, Pat. No. 4,507,887, which is a continuation of Ser. No. 498,804, May 27, 1983, abandoned.

[51] Int. Cl.[4] ..... G09F 17/00

[52] U.S. Cl. ..... 40/603; 40/606; 40/608; 40/612

[58] Field of Search ..... 160/383, 385, 390; 40/602, 603, 605, 604, 608, 610, 612; 244/153 R

[56] References Cited

U.S. PATENT DOCUMENTS 3,200,786 8/1965 Swezy et al. ..... 116/63 P
3,796,399 3/1974 Wechsler ..... 244/153 R
3,899,843 8/1975 Doyle et al. ..... 40/602
4,426,800 1/1984 Brown ..... 40/603

*Primary Examiner*—Gene Mancene
*Assistant Examiner*—Cary E. Stone
*Attorney, Agent, or Firm*—Harness, Dickey & Pierce

[57] ABSTRACT

An improved sign and sign stand assembly is disclosed wherein the sign panel is mounted on a frame member of the stand. The frame member permits the sign assembly to laterally pivot or swing under side-wind loads in order to allow a resilient portion of the frame member to deflect generally along a predetermined plane, thereby substantially preventing the sign assembly and stand assembly from tipping over. The sign assembly further includes an improved attachment mechanism for releasably attaching the sign panel to its associated support members or cross-braces. One or more straps are attached to the sign panel and wrapped around a cross-member. Such improved attachment mechanism is especially advantageous in connection with flexible sign panels.

15 Claims, 21 Drawing Figures

FIG. 12.
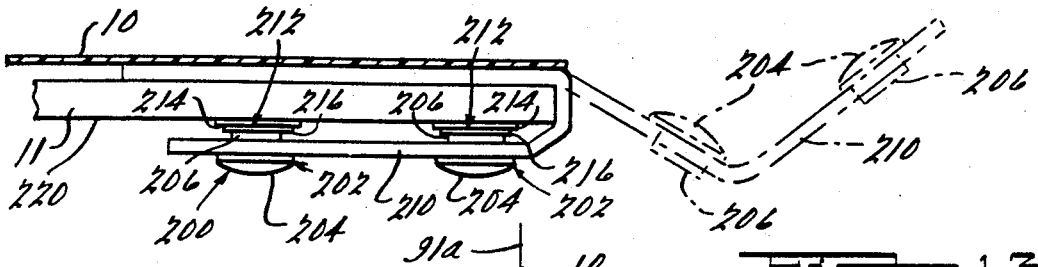
FIG. 13.
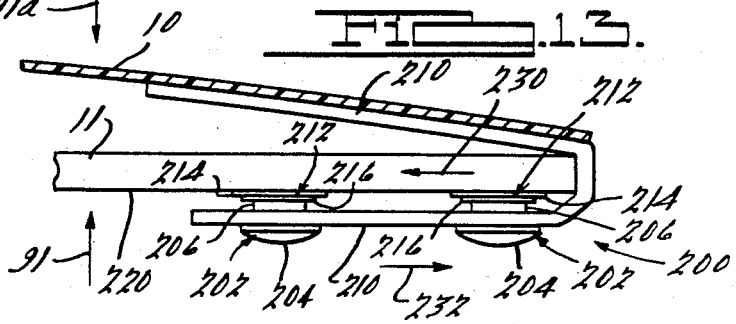
FIG. 14.
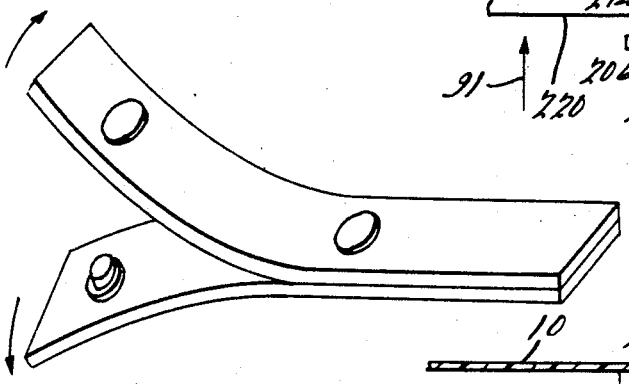
FIG. 15.
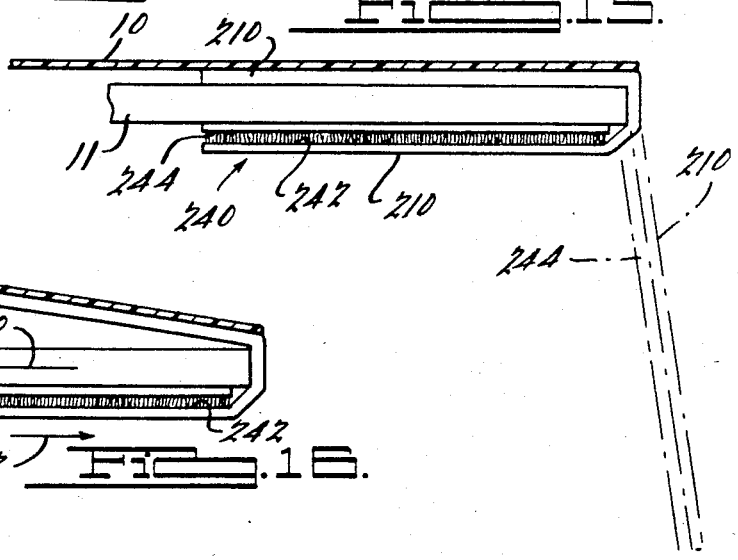
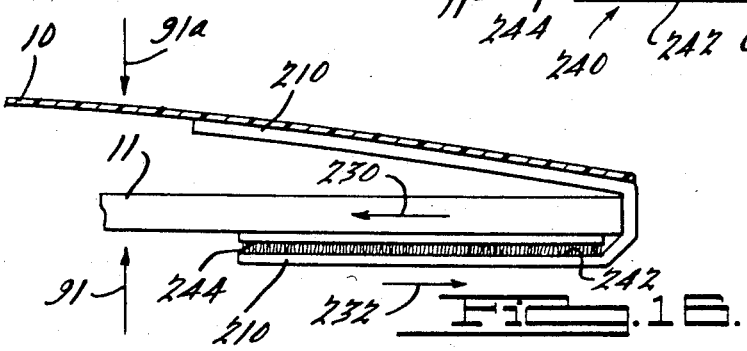
FIG. 16.
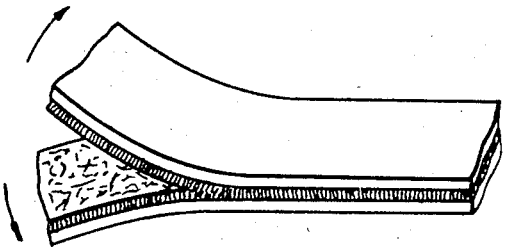
FIG. 17.

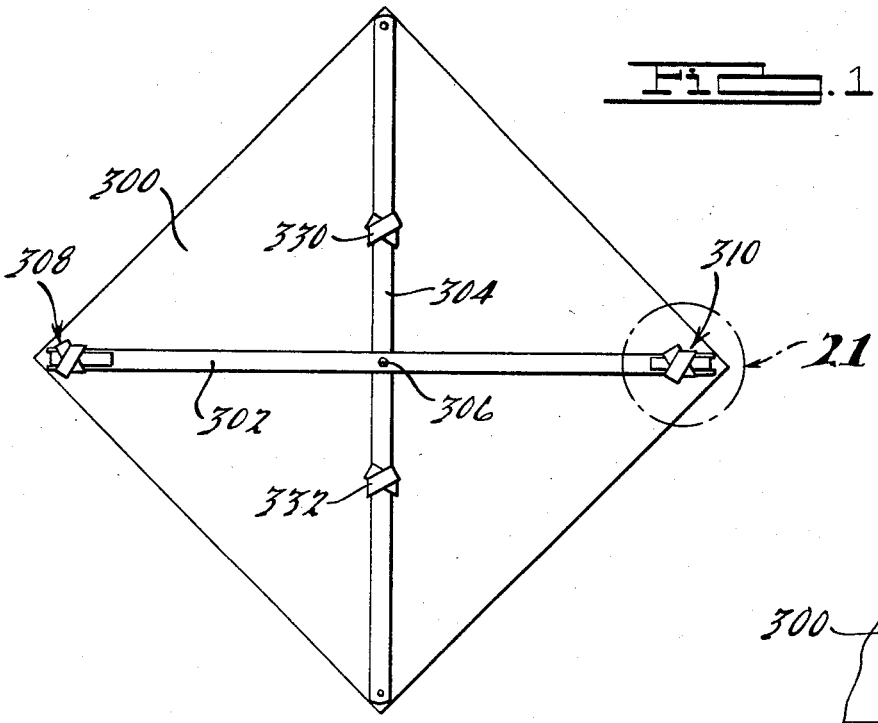
FIG. 18.
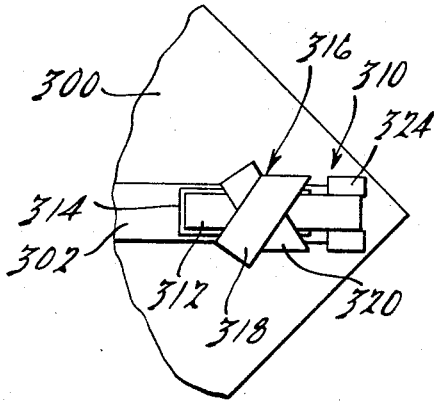
FIG. 21.
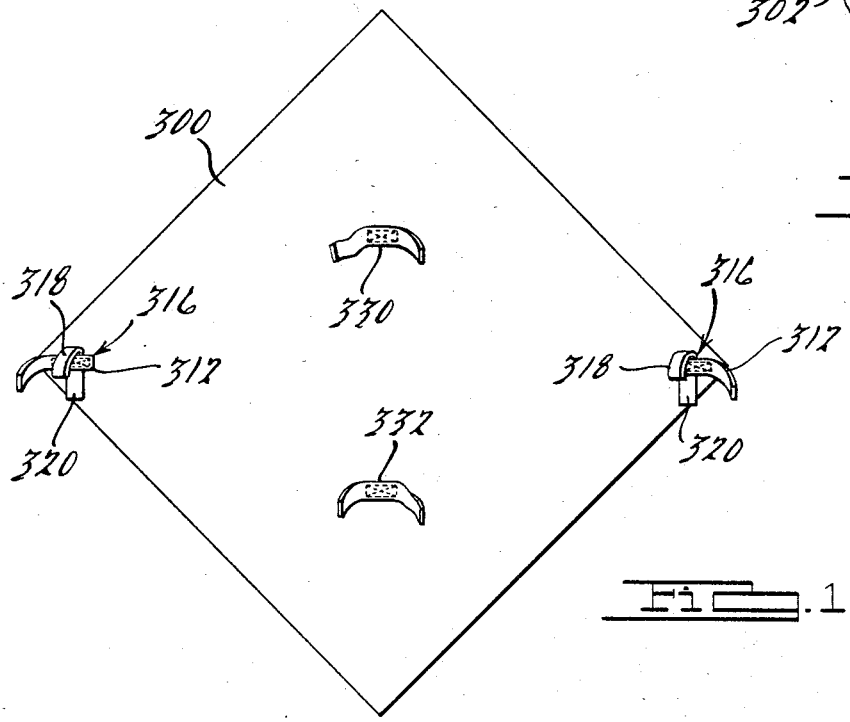
FIG. 19.
FIG. 20.
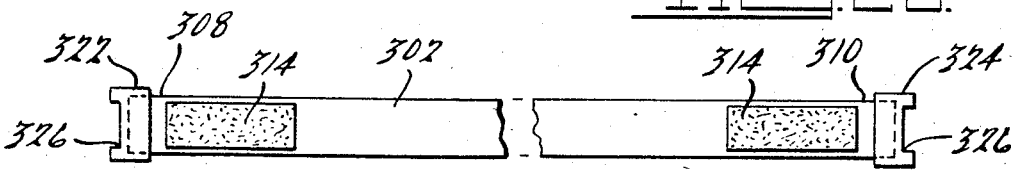

ROLL-UP SIGN WITH ATTACHMENT STRIPS

CROSS-REFERENCE TO RELATED APPLICATIONS

This application is a continuation-in-part of the copending application Ser. No. 623,622, filed on June 22, 1984, now U.S. Pat. No. 4,507,887, which in turn was a continuation of application Ser. No. 498,804, filed May 27, 1983, now abandoned.

BACKGROUND AND SUMMARY OF THE INVENTION

The present invention relates to sign and sign stand devices for signs and display devices of all kinds. The invention more particularly relates to means for securely holding roll-up and flexible signs in place without such signs becoming detached from their supporting structures or tipping over in high winds.

Numerous sign stands and poster display devices known today are used for displaying various signs and messages for conveying advertisements and information to the public. On construction sites, for example, such signs are typically positioned on sign standards that are either anchored in the ground, held in place by sandbags or other heavy objects, or spring-mounted on bases which allow them to bend or deflect generally along a predetermined plane, without tipping over, under high wind forces. Spring-mounted sign stands which can be used for this purpose are shown in U.S. Pat. Nos. 3,646,696; 3,662,482; 4,033,536; 4,265,040; and 4,288,053; as well as in copending patent applications, Ser. Nos. 274,400, filed June 17, 1981; 442,378, filed Nov. 17, 1982; 442,418, filed Nov. 17, 1982; and 442,419, filed Nov. 17, 1982. All of said copending applications are assigned to the same assignee as the invention herein, and their disclosures are hereby incorporated by reference herein. Such deflectable sign stands, although unanchored and lightweight, prevent tipping over or sliding of the units in virtually all weather and wind conditions.

Signs commonly used at construction sites are square, rectangular or diamond in shape, flat in configuration, made of metal or wood, and have pertinent informative or warning messages or symbols on them. The wood and metal signs are bulky and heavy, causing numerous problems in storage, transportation and mounting, and to overcome these problems, flexible roll-up type sign panels are being used more and more frequently today. These flexible sign panels are also typically square, rectangular or diamond-shaped signs but are made out of a heavy-duty flexible and foldable material, such as vinyl, or reinforced cloth or plastic. Such sign panels are lighter and thus easier to handle than metal or wood sign panels and are typically adapted to be rolled-up or folded-up for ease of transportation and storage.

The flexible or roll-up sign panels have one disadvantage when used with unanchored resiliently-mounted sign stands. Although signs including such sign panels work very satisfactorily when the wind forces are directed generally transversely to the plane of the sign panel, the flexible sign panels have a tendency to make the unanchored sign stands unstable when the wind forces are exerted in directions generally parallel to the plane of the sign panel.

The above-discussed roll-up sign panels typically have one or more relatively rigid cross-braces or support members to hold them in their fully extended configurations, with mounting means for mounting the sign panels to the support members and brackets or other means on sign stands for holding the sign assemblies on their stands. The cross-braces or supporting members are typically elongated members made of wood, fiberglass or a similar strong material, and are connected to one another in the middle so that they can be rotated together to a generally aligned position for storage. Examples of brackets and other apparatus used to hold roll-up signs on their sign stands are found in U.S. Pat. No. 4,288,053; as well as in the above-mentioned copending patent applications, which are assigned to the same assignee as the invention herein. Some of the brackets and sign panel mounting means presently in use with such roll-up signs, however, are often difficult and time-consuming to operate, are difficult to accurately position on the standard, and may not prevent the sign assembly from becoming detached from its stand under severe weather conditions. Furthermore, some of the flexible sign panels do not have adequate means for preventing them from becoming detached from their support members. For emergency use, it is often necessary that signs bearing warnings or emergency instructions be adapted to be set up and made operational with as little difficulty and as quickly as possible.

It is an object of the present invention to provide an improved sign and sign stand device having improved means for mounting the sign panel on its support structure and improved means for holding and securing the sign assembly on an upright or pole-type frame member of the sign stand. It is a further object to provide an improved sign bracket which overcomes the potential detachment and instability problems previously experienced with existing flexible roll-up signs in high wind conditions. A further object is to provide a sign that has the particular capability of quick and easy mounting or attachment of such roll-up or other flexible-type sign panels on their support members and on the frame member of the sign stand. A still further object is to provide a sign stand which securely holds a roll-up type sign in place regardless of orientation of the sign stand, regardless of wind conditions and regardless of wind direction.

In accordance with the present invention, a sign assembly includes a generally planar sign panel, which is preferably flexible and capable of being rolled-up for storage, and at least one support member for supporting the sign panel in its generally planar configuration. Mounting means is provided for releasably mounting or attaching the sign panel to the support member, including at least one preferably flexible strap member fixedly secured to the sign panel and releasable fastener means for releasably attaching the strap member to the support member.

In the preferred embodiment of the invention, the releasable fastener means includes a two-piece snap-type fastener assembly having a male portion that is adapted to be interlockingly, but releasably, engaged to a female portion. One of such portions of the snap-type fastener is secured to the strap member and the other portion is secured to the associated support member. The fastener portions are preferably mutually engaged between the strap and support members on an opposite side of the support member from the sign panel. By such a construction, the snap-type fastener is subjected primarily to a generally shear-type loading when the sign panel is subjected to wind forces in a general direction tending to separate the sign panel from the support member. The snap-type fastener thus resists separation and effectively retains the sign panel on its support member during such wind loads.

The releasable fastener means in an alternate embodiment includes a two-piece hook-and-loop fastener assembly, such as is known in the art, having a hook fastener portion and a loop fastener portion that are releasably engagable with one another. One of said hook-and-loop fastener portions is secured to the strap member, and the other is secured to the support member. The hook-and-loop fastener portions are preferably mutually engaged between the strap and support members on an opposite side of the support member from the sign panel. Like the preferred snap-type fastener discussed above, the hook-and-loop fastener assembly is subjected primarily to shear loading when the sign panel is subjected to wind forces in a direction tending to separate the sign panel from the support member. The hook-and-loop fastener thereby resists separation and effectively retains the sign panel on its support member during such wind loads.

It is also possible to include two hook-and-loop fasteners at one or more of the corners of the sign. This insures that the sign will not detach from the support members regardless of the severity of the wind and weather conditions. Other hook-and-loop fasteners can be positioned in the central area of the sign for fastening around one or more of the support members. These additional fasteners will keep the sign from billowing out from the support members in high winds.

In another preferred form of the invention, a sign stand preferably has an upstanding frame member that is resiliently deflectable relative to a ground-engaging base along a predetermined plane in response to wind forces directed generally transverse to the plane of the sign panel. The mechanisms for attaching the sign assembly to the sign stand in the various embodiments of invention are preferably adapted to permit or cause the sign assembly to pivot or swing laterally about a generally vertial axis in response to side-wind forces directed generally parallel to the plane of the sign panel. Such pivotal movement of the sign assembly to be oriented generally transverse to the sign permits or causes the frame member to deflect generally along the above-mentioned predetermined plane, thereby preventing the sign stand from tipping over. The various alternate sign assembly attachment mechanisms of the present invention are also particularly adapted to prevent the sign assembly from becoming detached from the frame member during such lateral pivotal movement of the sign. Also, the various alternate sign stands of the present invention have the particular capability of quick and easy attachment of a sign assembly including a flexible sign, on the frame member of the sign stand.

Other objects, features and advantages of the present invention will become apparent from the following description and claims, taken in conjunction with the accompanying drawings.

BRIEF DESCRIPTION OF THE DRAWINGS

FIG. 12 is a cross-sectional view taken along the plane of section line 12—12 of FIGS. 2 and 6, illustrating the preferred snap-type fastener assembly for attaching the sign panel to its support member.

FIG. 13 is a view similar to that of FIG. 12, but illustrating the sign panel being subjected to wind forces exerted against its rearward side.

FIG. 14 is a schematic view, illustrating peel-type separation of a conventional snap-type fastener device.

FIG. 15 is a view similar to FIG. 12, but illustrating the alternate hook-and-loop fastener assembly for attaching the sign panel to its support member.

FIG. 16 is a view similar to that of FIG. 15, but illustrating the sign panel being subjected to wind forces exerted against its rearward side.

FIG. 17 is a schematic view, similar to FIG. 14, but illustrating peel-type separation of a conventional hook-and-loop fastener device.

FIG. 18 is a rear perspective view of a roll-up sign in accordance with another embodiment of the invention.

FIG. 19 is a rear view of the sign panel of FIG. 18 showing some of the various possible hook-and-loop fasteners.

FIG. 20 is an elevational view of one of the cross (support) members of the sign of FIG. 18.

FIG. 21 is an enlarged view of the encircled area indicated by the reference number 21 in FIG. 18.

DETAILED DESCRIPTION OF THE PREFERRED EMBODIMENTS

Figure 1:
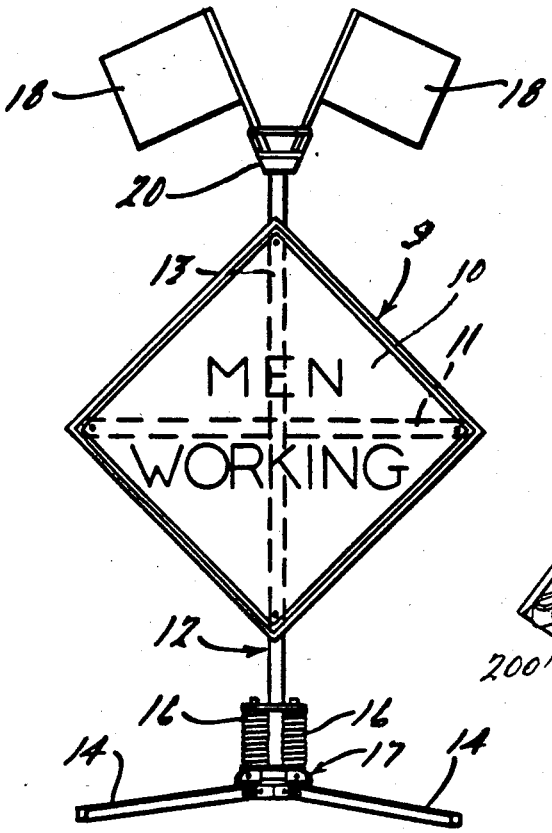
FIG. 1 is a front view of a construction-type sign stand.

The drawings show merely exemplary embodiments of the present invention for purposes of illustration only. One skilled in the art will readily recognize that the principles of the invention are well-adapted for application to devices other than sign and stand assemblies as well as to sign and stand assemblies other than those shown in the drawings.

FIGS. 1 through 5 show an improved sign attachment bracket for use on a construction sign, with the sign assembly 9 attached to an upright sign frame or pole 12. The frame 12 is supported on the ground preferably by a plurality of ground-engaging legs 14 and a pair of coil springs 16 which allow the sign assembly 9 and frame 12 to deflect relative to the base assembly 17 in a downward direction when subjected to wind forces and then resiliently return to their normal upright position shown in FIG. 1. Spring-mounted sign stands which can be used for this purpose are disclosed in the above-mentioned U.S. Pat. Nos. 3,646,696; 3,662,082; 4,033,536; 4,265,040; and 4,288,053; and in the above-mentioned copending applications, which are assigned to the same assignee as the invention herein. It is understood, of course, that the mounting bracket of FIGS. 1 through 5 may also be used with other types of sign stands or frame members, whether permanently anchored or portable.

The top of the frame 12 may optionally include a plurality of warning flags 18 held in place by a flag bracket 20. As is commonly known in the construction industry, the flags 18 are used as a high-level warning for approaching traffic.

Figure 2:
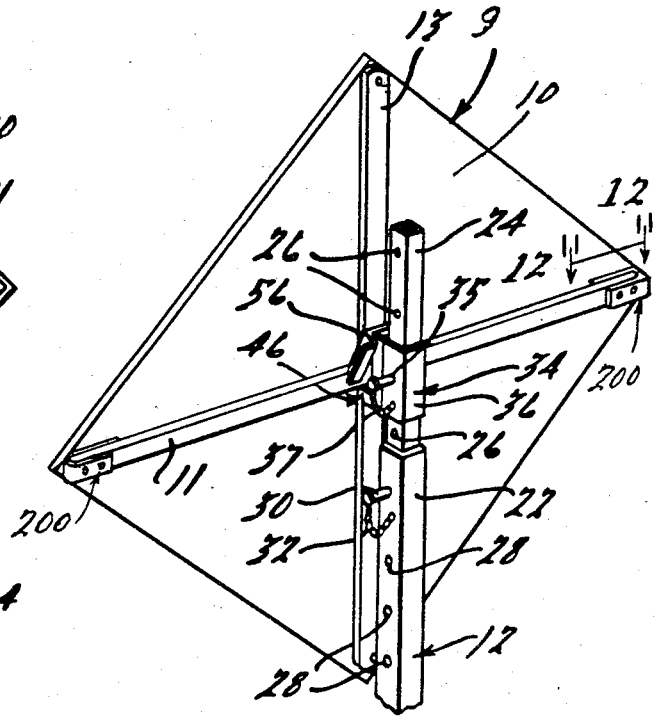
FIG. 2 is a partial rear perspective view of the construction sign shown in FIG. 1, depicting an embodiment of the invention having an adjustable sign bracket assembly.
Figure 3:
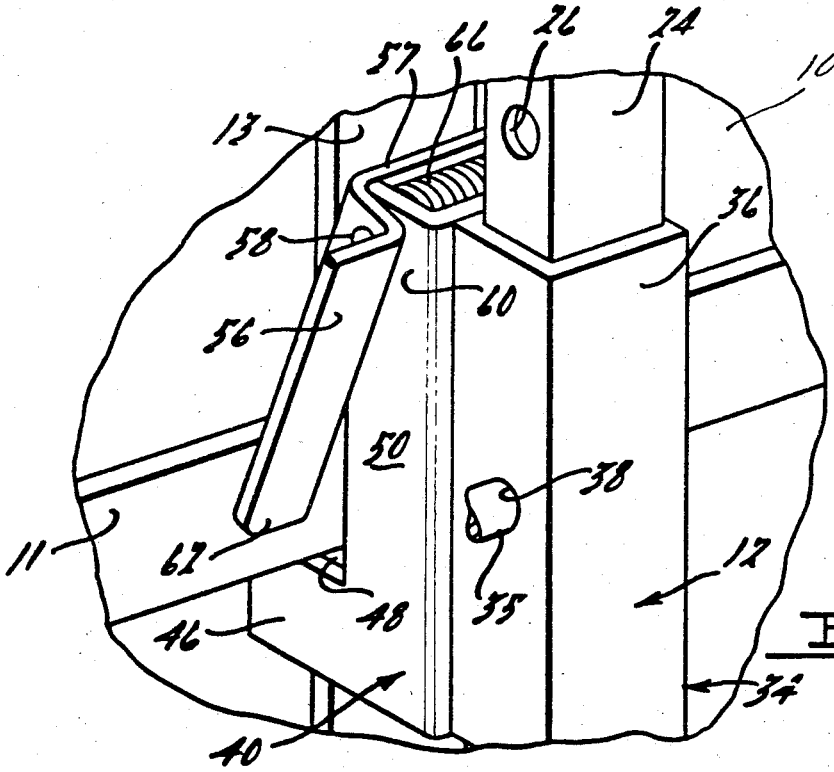
FIG. 3 is an enlarged rear view, with the portions cut away, of the sign bracket portion of FIG. 2.

As shown in FIGS. 2 and 3, the frame 12 may optionally be telescopic and include two sections, a larger lower section 22 and a smaller upper section 24. The upper section 24 is adapted to slidably extend and retract inside the lower section 22 and has a plurality of holes 26 which align with corresponding holes 28 in the lower Section 22 so that the sections can be held in place at the desired extended or retracted position by a pin 30 which is insertable through aligned pairs of holes 26 and 28. The pin 30 is attached to portion 22 of the frame 12 by a chain 32 or other similar retainer means so that the pin 30 will not be lost or misplaced when removed from the holes. Alternatively, the frame 12 may have a one-piece construction (not shown), if the above-discussed telescopic feature is neither necessary nor desired.

The frame 12 may be composed of any conventional material which is sturdy enough to be used for the purpose described herein, but is preferably composed of a hollow metal construction, such as aluminum or steel. Hollow frames made from extruded aluminum material have provided very satisfactory performance. The cross-sectional shape of the frame 12 is preferably square (as shown in FIGS. 2 and 3), although it should be understood that the frame can have any suitable cross-sectional size and shape so long as it can be used as a stand for a construction sign or similar display.

The sign assembly 9 preferably has a large flexible and foldable sign panel 10 with a warning, message or symbol on one side and a pair of support members or cross-braces 11 and 13 pivotally attached to one another on the other side. The flexible sign panel 10 is preferably composed of a heavy-duty material such as vinyl or reinforced cloth or plastic, for example. The support members or cross-braces 11 and 13 are made of a relatively rigid material (such as fiberglass, metal or wood) and serve to brace and support the flexible sign panel in its fully extended position. As shown in FIGS. 2 and 3, one of the cross-braces 11 is pivoted to a horizontal position when the sign is mounted or attached to the frame 12, while the other cross-brace 13 is vertically situated. An attaching means described below may be used to retain the corners of the sign panel 10 at the ends of the cross-braces 11 and 13 in order to erect the sign to its display configuration. When the sign assembly 9 is removed from the frame member 12 and is to be taken down, at least two of the corners of the flexible sign panel material 10 are detached, as described in more detail below, from the ends of their corresponding cross-brace, and the cross-braces are pivoted to a generally parallel, mutually-aligned relationship. The flexible sign panel material 10, which remains attached to one of the cross-braces, may then be folded or rolled up around the mutually-aligned cross-braces for compact, convenient storage.

The sign assembly 9 is held in place on the sign stand or frame 12 by an adjustable sign bracket 34. As shown in FIGS. 2 through 5, the bracket preferably includes a sleeve-type bracket mounting member 36 that is hollow and adapted to slidingly fit over the frame 12. The cross-sectional size and shape of the sleeve member 36 should preferably correspond to the cross-sectional size and shape of the frame 12.

The sleeve member 36 includes a pin 35 attached thereto by a chain 37 or other similar means to prevent the pin 35 from being lost or misplaced. The pin 35 may be inserted through an aligned pair of holes 38 in the sleeve member and through any of the various aligned holes 26 on the upper section of the frame 12 in order to selectively position the bracket 34 at the desired vertical height. It should be noted that the number and spacing of the holes 26 and 28 on the upper and lower sections of the frame 12 will, of course, depend upon the desired use of the sign stand.

Figure 4:
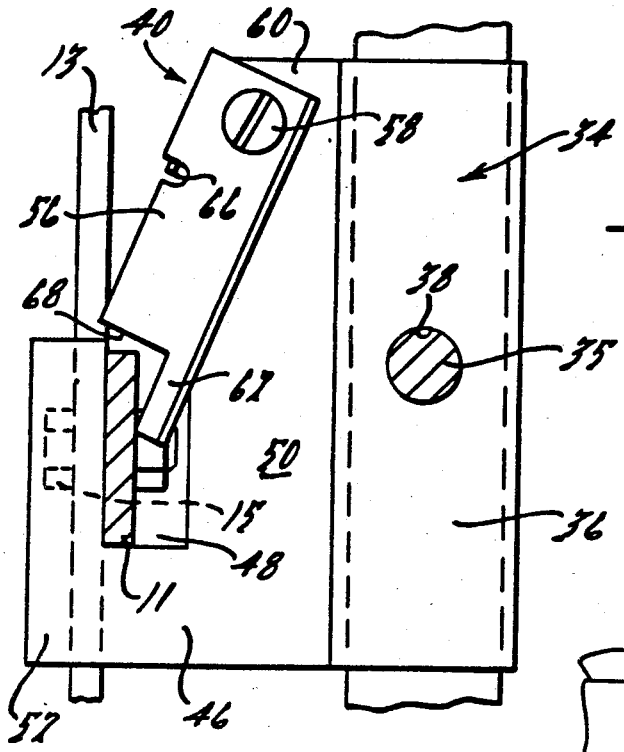
FIG. 4 is a side view of the sign bracket assembly of FIG. 2.
Figure 5:
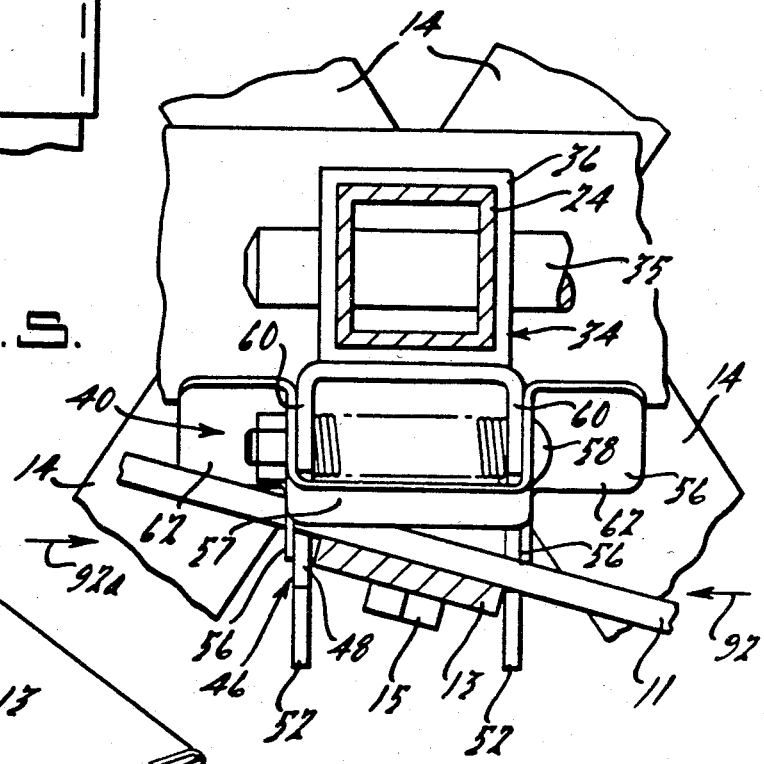
FIG. 5 is a top view of the sign bracket assembly of FIG. 2, illustrating the lateral pivotal movement of a cross-brace of the sign.

As is illustrated in FIGS. 3 through 5, the sign bracket 34 includes sign attachment means 40 fixedly secured to the sleeve member 36. The sign attachment means 40 preferably includes a pair of upwardly-presenting channel members 46 protruding in an outward direction from the sleeve member 36. Each of the channel members 46 includes an inner leg 50 spaced apart from an outer leg 52, with the inner and outer legs being interconnected by a base member 54. The channel spaces 48 in each of the channel members 46 are laterally aligned with each other such that the horizontal cross-brace 11 may be positioned in the channel spaces 48 in order to mount the sign on the sign bracket 34.

As shown in FIGS. 3 through 5, a pair of latching members 46 are preferably interconnected by a bridge portion 57 for pivotal movement with one another about a pivot pin 58 extending through apertures in the latching member and in an upper bracket portion 60. A biasing spring 66, which is preferably a torsion-type spring, surrounds the pivot pin 58 and includes end protuberances that engage the bridge portions 57 and the upper portion of the base member 54 to resiliently bias the latching members toward the outer legs 52 as shown in FIG. 4. An abutment portion 62 at the lower end of each of the latching members 56 cooperates with the biasing spring 66 to resiliently urge the horizontal cross-brace 11 against the outer legs 62 when the latching members 56 are in the closed position shown in FIG. 4. In such closed position, the latching members 56 and the channel members 46 at least partially circumscribe the horizontal cross-brace 11 to retain the cross-brace in the channel spaces 48. Although the above-described interconnected latching members are preferred, separate latching members may alternatively be employed.

It should be noted that when the latching members 56 are in their above-described closed position, as perhaps best shown in FIG. 5, the lower edges 68 of the latching members 56 are disposed above the upper edge of the cross-brace 11. By such a relationship, the latching members 56 prevent the cross-brace from being lifted or otherwise moving upwardly, under the influence of wind gusts, for example, and thus escaping from the channel spaces 48. As is shown in FIG. 5, this relationship between the cross-brace 11 and at least one of the latching members 56 is maintained even when the sign assembly 9 pivots or swings laterally in response to side-directed wind loads, as described below and shown in FIG. 10.

The sign attachment means 40 of the sign bracket 34 also facilitates the quick and easy attachment and removal of the sign assembly 9 from the sign stand assembly. In order to attach the sign assembly 9 to the sign bracket 34, the latching members 46 are pivoted inwardly toward the inner legs 50 against the force of the biasing spring 66. The cross-brace 11 is then merely inserted or positioned into the channel spaces 48 in the channel members 46. The latching members 56 are then released, and the latching members 56 pivot outwardly under the force of the biasing spring 66 to engage and circumscribe the cross-brace 11, as shown in FIG. 5, thereby retaining the cross-brace in the channel spaces 48. Alternatively, the cross-brace 11 may be urged in a generally inward and downward direction against the outer edges of the latching members 56 in order to forcibly pivot the latching members inwardly toward the inner legs 50 against the force of the biasing spring 66. The cross-brace 11 then slides downwardly along the outer edges of the latching members and into the channel spaces 48. Once the cross-brace passes below the lower edges 68 of the latching members, the latching members automatically pivot or "snap" outwardly under the force of the biasing spring 66 to engage and circumvent the cross-brace as shown in FIG. 5.

In order to remove the sign assembly 9 from the sign bracket 34, the latching members 56 are manually pivoted inwardly against the force of the biasing spring 66, and the cross-brace 11 is merely lifted out from the channel spaces 48. Once the cross-brace 11, and the sign assembly 9 have been removed from the frame 12, the latching members 56 may be released to be biasingly pivoted outwardly by the biasing spring 66.

When wind forces are exerted on a sign and stand assembly, a torque is developed which tends to tip over the assembly. This wind torque equals the product of the wind force and the distance from the ground to the vertical center of the sign. Such wind torque is resisted by a so-called resistance torque, which is the product of the weight of the sign and stand assembly and the distance from the lateral center of the assembly to a tipping axis about which the assembly would rotate if tipping over under the influence of a given wind force. Such tipping axis in the embodiments of the invention described herein is generally a line intersecting the outward ends of the down-wind legs. Thus the sign and stand assembly would tip over if the wind torque tending to tip over the sign and stand assembly exceeds the resistance torque tending to maintain the sign and stand assembly in an upright position.

In order to prevent the sign and stand assembly from tipping over in high winds, the assembly is provided with means for permitting the frame member to deflect downwardly in response to wind forces generally transverse to the plane of the sign as well as in response to wind forces generally parallel to the plane of the sign panel 10. By allowing the frame member to deflect downwardly, the height of the vertical center of the sign is reduced, thereby reducing the above-described wind force to a level less than that of the resistance torque of the sign and stand assembly.

Figure 10:
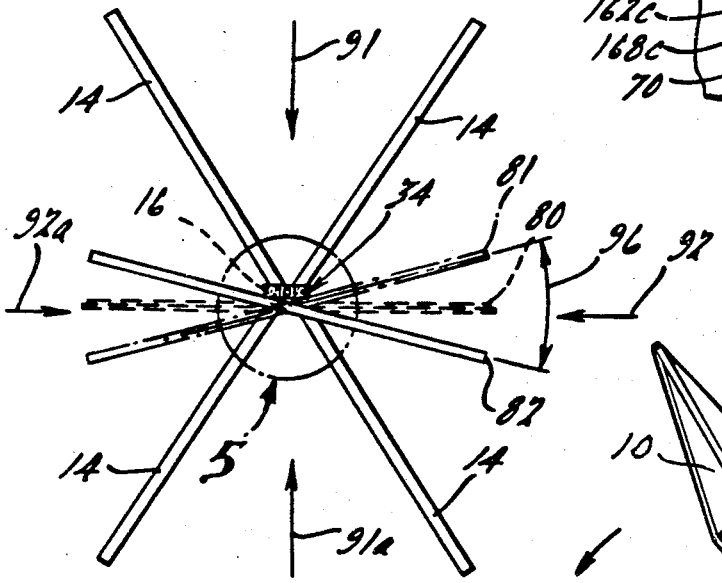
FIG. 10 is a top view of the sign and stand assembly of the present invention, illustrating the lateral pivotal or swinging movement of the sign.
Figure 11:
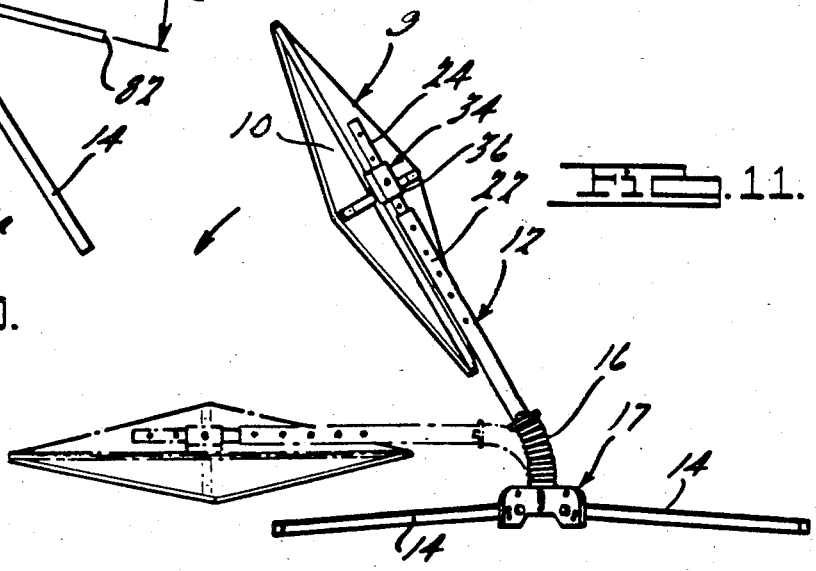
FIG. 11 is a side view of the sign and stand assembly of the present invention, illustrating the frame member in a partially downwardly-deflected position.

Referring to FIGS. 5, 10 and 11, the coil springs 16 provide a resilient connection between the frame 12 and the base assembly 17 such that the frame 12 is resiliently deflectable generally along a predetermined plane, which is generally perpendicular to the plane of the sign panel when the sign panel is in its normal orientation 80 shown in FIG. 10. Such deflection occurs in response to the first wind forces that are exerted on the sign in a direction generally transverse to the plane of the sign panel 10, such as those illustrated by reference numerals 91 or 91*a*, for example. It should be understood, however, that such transversely-directed first wind forces need not be exerted in a direction perpendicular to the plane of the sign panel 10 (when in its normal signal plane orientation 80) in order to cause such deflection of the coil springs 16. It is sufficient that such transversely-directed wind forces have enough of a force vector component in a direction perpendicular to the normal sign panel orientation 80 such that the coil springs 16 may be caused to deflect.

Spring mounted sign stands in accordance with the above-identified patents preferably have the ability to deflect to a point where the sign assembly 9 is generally parallel to the ground (as shown in FIG. 11). In order to insure that the sign and stand assembly do not tip over in side-wind loading conditions, such as the second wind forces 92 or 92*a* exerted in a direction generally parallel to the normal sign plane orientation 80, the sign bracket 34 preferably includes means for allowing the sign to pivot or swing laterally about a generally vertical axis in response to such side-wind loads. Such capability allows the pivoted sign to assume sign orientations such as those illustrated by reference numerals 81 and 82 in FIG. 10.

In this embodiment, such means for allowing such lateral pivotal or swinging sign movement is provided by the channel spaces 48, which are sufficiently wider in the inner and outer directions than the cross-brace 11 to allow the cross-brace to pivot about a generally vertical axis as illustrated in FIGS. 5 and 11. As is discussed above and further shown in FIG. 5, the resilient biasing of the latching members 56 toward the outer legs 52 maintains at least one of the latching members in the above described circumscribing relationship with the cross-brace 11 during such pivoting of the sign. The resilient biasing spring 66 is thus sufficiently stiff to maintain such relationship, but resiliently yieldable enough to allow such lateral pivotal or swinging movement of the cross-brace 11 and the sign assembly 9 in response to side-wind loads. It should also be noted that the biasing spring 66 cooperates with the latching members 56 to resiliently bias the cross-brace 11 against the outer legs 62, as described above, when the side-wind load is not sufficient to cause the sign assembly to pivot. Thus the sign assembly is maintained in a stable orientation generally perpendicular to approaching traffic during light-load or no-load wind conditions.

When sign assembly 9 pivots or swings laterally about a generally vertical axis to a transverse orientation relative to side-directed winds, as discussed above, the second wind forces (such as 92 or 92*a*) have a force vector component exerted against the sign assembly in a direction sufficiently transverse to the sign such that the coil springs 16 may resiliently deflect the frame 12 along the above-described predetermined plane as shown in FIG. 11. The biasing springs 66 and the coil springs 16 are selected with appropriate spring constants such that sufficient lateral pivotal movement of the sign assembly occurs to cause or allow the resultant deflection of the frame member to occur before the sign and stand assembly can tip over under the second wind forces. Although the exact range of pivotal swinging movement of the sign assembly depends upon several factors such as the sign size and weight and the spring constants, for example, a range of pivotal or swinging sign movement through a total arc 96 (as shown in FIG. 10) of approximately 10–35 degrees, and preferably through an arc of approximately 15 degrees to either side of the normal sign plane orientation, has been found to provide satisfactory results. Either smaller or larger ranges of pivotal or swinging movement may also be sufficient to cause or allow the desired frame deflection depending upon the particular application of the principles of the invention.

As shown and described above, the sign bracket provides for simple, quick and easy attachment and removal of sign assemblies on frames of sign stands, as well as minimizing the possibility of a sign stand assembly with a roll-up sign tipping over in high winds from a side direction. The sign attachment bracket is preferably made of steel or aluminum, but can be made of any material which is strong enough to withstand the forces construction signs are normally exposed to in use. Although the bracket of this embodiment of the invention is described above as being used for flexible or roll-up type sign panels of diamond shape, it is apparent that the bracket can be used with a wide variety of sign panels of different materials, rigid or soft, and with sign panels of widely varying sizes and shapes. With rigid sign panels, a flange or protruding member at least functionally similar to the cross-brace 11 should be provided and should be adapted to fit within the channel spaces 48 on the bracket 34.

FIGS. 6 through 9 illustrate an alternate construction of the invention employed in a sign and stand adapted for use near an accident scene for providing a warning to oncoming motorists. A warning sign assembly 9*a* is mounted or attached to a relatively short upright sign frame or pole 12*a*, and the frame 12*a* is supported on the ground by a plurality of ground-engaging legs (not shown). The pair of coil springs, similar to those shown in FIG. 1 discussed above, interconnect the frame 12*a* with a base assembly (not shown) and allow the sign assembly 9*a* and frame 12*a* to deflect downwardly when subjected to wind forces and then to return to their normal upright position.

The ground-engaging legs are preferably telescopic and are preferably pivotally attached to the base assembly in order to be extended and folded downwardly to a ground-engaging position generally perpendicular to the frame 12*a* or retracted and folded upwardly to a folded position generally adjacent and parallel to the frame 12*a*. It should be noted that the legs 14 of the embodiment discussed above in connection with FIGS. 1 through 5 may also optionally be telescopic and foldable similar to the legs of the embodiment of FIGS. 6 through 9.

The sign assembly 9*a*, like the sign assembly 9 discussed above, includes a large flexible panel with a warning message or symbol on one side and the above-discussed pair of cross-braces 11 and 13 pivotally attached to one another on the other side. The cross-braces 11 and 13 are made of a fiberglass or similar material, are relatively rigid in order to brace and support the flexible sign panel in its fully extended position, and yet are sufficiently flexible to be twisted to allow lateral movement of the sign as discussed hereinafter. As discussed above, the cross-brace 11 is situated in a horizontal position when the sign assembly is mounted on the frame 12*a*, while the other cross-brace 13 is vertically situated and retained by the frame 12*a* as described below.

Figure 7:
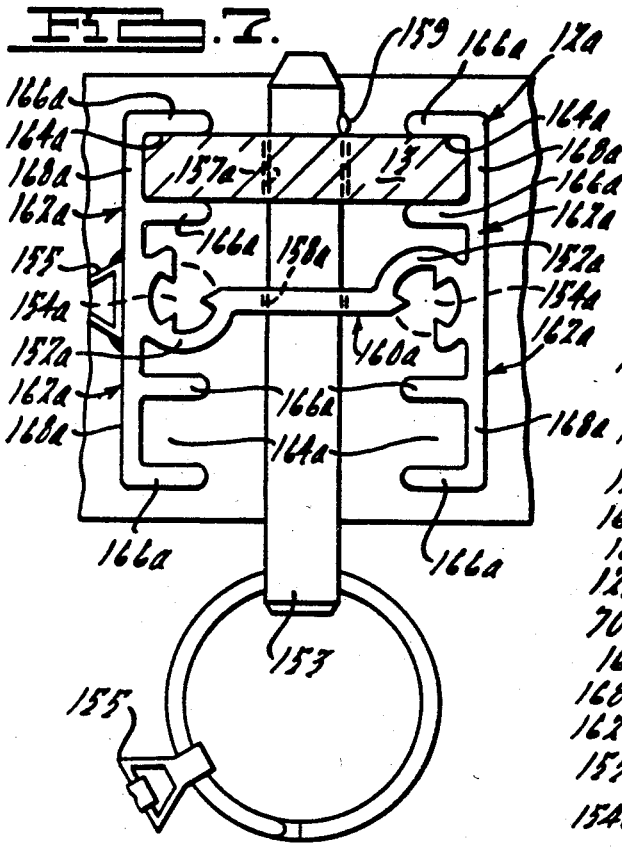
FIG. 7 is a cross-sectional view taken along the plane of section line 7—7 of FIG. 6.
Figure 8:
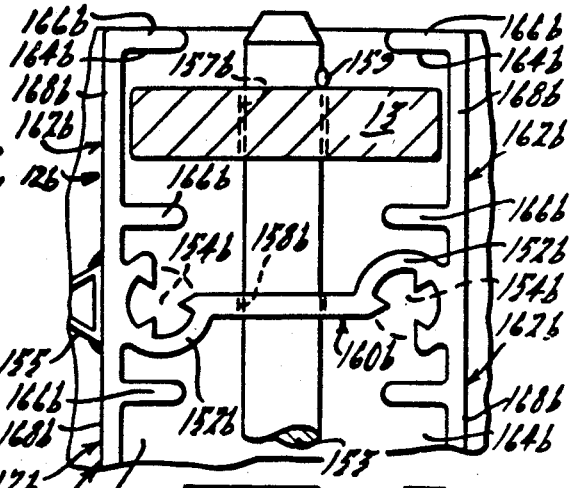
FIG. 8 is a cross-sectional view similar to that of FIG. 7, but illustrating another embodiment of the sign and stand construction of FIG. 6.

As is illustrated in FIGS. 7 and 8, the frame 12*a* is preferably an extruded member having any of several predetermined cross sections described below. The frame may be composed of any conventional material that is sturdy enough to be used for the purpose described herein, but is preferably composed of a metal, such as light-weight extruded aluminum, for example. Frames made from such extruded aluminum material have provided very satisfactory performance.

The cross-sectional shape of the frame 12*a* as shown in FIG. 7, includes a central support member 160*a* and a pair of symmetrical flanges 162*a* protruding in opposite directions on each end of the central support member 160*a*. The outermost ends of the flange members 162*a* each include a generally U-shaped channel 164*a*. The channel 164*a* are identical, but symmetrically opposite, and are each formed by a pair of generally parallel channel legs 166*a* interconnected by a channel base 168*a*. Preferably, in the embodiment showing FIG. 7, the width of the space between the corresponding channel legs 166*a* is such that the vertical cross-brace 13 may be slidably and interferingly inserted into the pair of channels 164*a* on either of the opposite sides of the frame 12*a* in order to be frictionally attached and retained therein. Such a symmetrically opposite sign attachment configuration allows the warning sign assembly 9*a* to be very quickly erected and attached to the frame 12*a* merely by frictionally inserting the vertical cross-brace 13 within the pair of channels 164*a* on either of the identical sides of the frame 12*a*. Therefore, no matter which of the opposite sides of the frame is oriented toward oncoming traffic when the stand is set up, the user may quickly erect and display the warning sign without having to reorient the sign stand assembly. Of course, it is also possible to, if desired, provide a frame 12*a* with just one pair of channels 164*a* on only one side of the frame 12*a* in accordance with the present invention.

Figure 6:
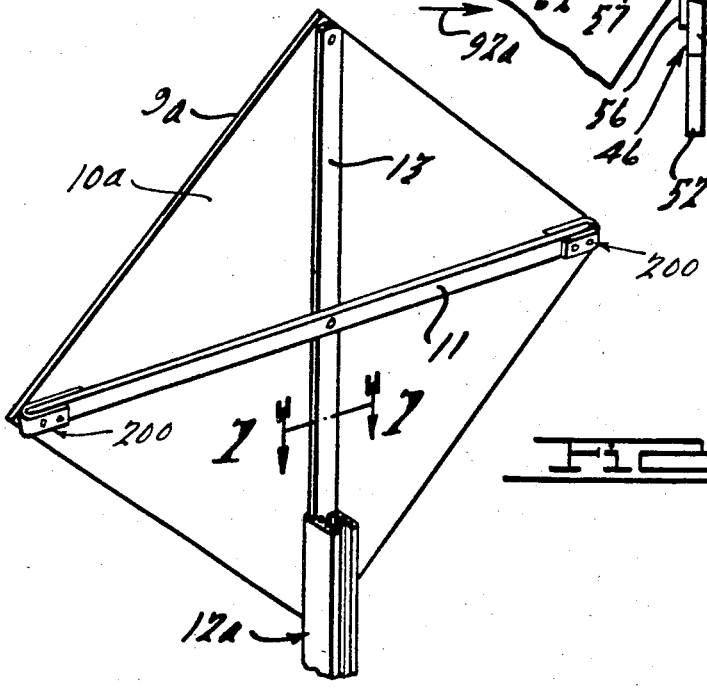
FIG. 6 is a partial rear perspective view similar to FIG. 2, but depicting a sign and stand device having an alternate construction according to the present invention.

Referring to both FIGS. 6 and 7, it should be noted that only a relatively short portion of the lower end of the vertical cross-brace 13 is inserted into, and frictionally engaged by, the frame 12*a*. Thus, enough of the cross-brace 13 is engaged by the frame 12*a* to securely mount the sign assembly 9*a* thereon, but a relatively large vertical portion of the cross-brace 13 is left unsecured by the frame 12*a*. Such unsecured portion of the cross-brace 13 is sufficiently long that it may resiliently and torsionally twist under the influence of side-directed wind loads as is explained more fully later in this description.

Because of the relatively short length of the cross-brace 13 that is frictionally secured to the frame 12*a*, a hitch pin 153*a* may optionally be attached to the frame 12*a* by a chain 155*a* for insertion through apertures 157*a* and 158*a* in the cross-brace 13 and the frame 12*a*, respectively. Although use of such a hitch pin may not be necessary in most instances to insure retention of the cross-brace in the frame member channels, it may be deemed desirable or necessary in particular applications of the invention. If included on frame 12*a*, however, the hitch pin 153*a* preferably includes a spring-loaded detent means 159*a* at its free end for substantially preventing the hitch pin from vibrating loose or otherwise slipping or working free from its engagement with the cross-brace 13 and the frame 12*a*. The hitch pin and its related apparatus are described in more detail below in connection with the discussion of FIG. 8.

Preferably, the frame 12*a* also includes a pair of base attachment receptacles 152*a* on at least one side of the central support member 160*a*. The base attachment receptacles 152*a* are preferably extruded integrally with the frame 12*a* and are adapted to receive fasteners 154*a* extending upwardly through an upper plate 156*a* for securing the frame 12*a* to the coil spring assembly discussed above. The fasteners 154*a* are preferably self-tapping screws that threadably and frictionally engage the sides of the base attachment receptacles 152*a* and are long enough to adequately support the frame 12*a*.

Like the embodiment of the invention described above in connection with FIGS. 1 through 5, the various embodiments shown in FIGS. 6 through 9 also provide means for substantially preventing the sign and stand from tipping over in high winds. In this regard, the pivoting and deflecting motion of such embodiments, to be described in detail below, are similar to that shown in FIGS. 10 and 11 for the embodiment of FIGS. 1 through 5. Therefore, the embodiments of FIGS. 6 through 9 will also be described herein with reference to FIGS. 10 and 11 for purposes of convenience. It will be readily apparent from such description that the embodiments of FIGS. 6 through 9 also include means for reducing the wind torque on the sign and stand assembly to a level less than that of the assembly's resistance torque, as described above.

The coil springs on the frame 12*a* provide a resilient connection between the frame and the base assembly such that the frame 12*a* is resiliently deflectable generally along a predetermined plane, which is generally perpendicular to the plane of the sign assembly 9*a* when in its normal orientation 80 as shown in FIG. 10. In use during high wind forces, the spring mounted sign stands in accordance with the above-mentioned patents and copending applications can deflect to a point where the plane of the sign panel is generally parallel to the ground. Regardless of the amount of deflection, the sign assembly resiliently returns to its upright position when the wind forces subside.

In most cases during use, the deflection of the sign assembly occurs in response to wind forces that are exerted on the sign in a direction generally transverse to the plane of the sign panel 10, such as those illustrated by reference numerals 91 or 91*a* in FIG. 10, for example. Thus, as is described above, it should be understood that such transversely-directed wind forces need not be exerted in a direction perpendicular to the plane of the sign panel when in its normal sign orientation 80 in order to cause such deflection of the coil springs. It is sufficient merely that such transversely-directed forces have enough of a force vector component in a direction perpendicular to the normal sign orientation 80 such that the coil springs may be caused to deflect.

In order to insure that the sign and stand assembly will remain stable in side-wind load situations, such as in response to second wind forces 92 or 92*a* exerted on the sign assembly in a direction generally parallel to the normal sign panel orientation as shown in FIG. 10, the frame 12*a* shown in FIG. 7, and the alternate frame 12*b* and 12*c*, shown in FIGS. 8 and 9, and discussed below, include means for allowing the sign assembly to pivot or swing laterally about a generally vertical axis. Such capability allows the pivoted sign assembly to assume sign orientations such as those illustrated by reference numerals 81 and 82 in FIG. 10, which in turn allow the stand to pivot and deflect along the above-mentioned predetermined plane as is more fully explained below.

In the embodiment of the invention illustrated in FIG. 7, the capability of allowing the sign assembly 10*a* to pivot or swing laterally is provided by the above-discussed unsecured portion of the cross-brace 13. Such unsecured portion is sufficiently long and sufficiently flexible to torsionally twist about a generally vertical axis in response to the side-directed second wind forces 92 or 92*a*, for example. Such torsional twisting thus permits the sign assembly to pivot laterally as shown in FIG. 10. When the sign assembly pivots or twists laterally about said generally vertical axis to a transverse orientation relative to such side-directed winds, the second wind forces, such as 92 or 92*a*, have a force vector component exerted in a sufficiently transverse direction against the sign panel such that the coil springs may resiliently deflect the frame along the above-discussed predetermined plane, as shown in FIG. 11. The length and flexibility of the unsecured portion of the cross-brace 13 should be sufficient to allow enough torsional twisting of the cross-brace to permit the sign panel to laterally pivot far enough to cause the coil springs to deflect along such predetermined plane before the sign and stand assembly can tip over under the load of the second wind forces.

As mentioned above, the exact range of lateral pivotal or swinging motion of the sign assembly depends upon many factors such as sign size, height and weight and coil spring constants, for example. However, a range of lateral pivotal movement through a total arc 96 in FIG. 10 approximately 10–35 degrees, and most preferably approximately 15 degrees swing to either side of the normal sign orientation 80, has been found to provide satisfactory results. Either smaller or larger ranges of such pivotal sign assembly movement may also be found to be sufficient or necessary in order to provide satisfactory results, depending upon the particular physical constraints present and the particular application of the principles of the invention. It should be realized, however, that such pivotal or swinging movement should not be significantly greater than that necessary to allow deflection of the frame along the above-mentioned predetermined plane in order to prevent the sign assembly from becoming oriented so far askew to oncoming traffic that it cannot be read and observed by such traffic.

Referring to FIG. 8, another embodiment of the present invention includes a stand frame 12*b* generally similar to the stand frame 12*a* shown in FIG. 7, with the exceptions described below. As an alternative for the torsional twisting of the unsecured portion of the cross-brace 13, it is also possible to allow the cross-brace to pivot or swing freely inside the channels 164*b*, i.e. without any frictional engagement. In this embodiment, as shown in FIG. 8, the channels 164*b* are made sufficiently large to allow the vertical cross-brace 13 to slide easily into the channels without contacting the leg portions 166*b* in order to permit sufficient lateral pivoting of the cross-brace upon application of side-directed wind forces such as 92 and 92*a*, for example. In order to prevent the sign assembly from slipping out of the channel when the frame 12 is deflected (as shown in FIG. 10), the hitch pin 153*b* is inserted through the aperture 158*b* in the cross brace 13 and through the corresponding aperture 159*b* in the frame 12*b*. Similar to the embodiment shown in FIG. 7 above, two channels 164*b* are preferably provided on opposite sides of the frame 12*b* so that the cross-brace 13 can be inserted in the properly-oriented side (facing the traffic) once the stand is set up in place.

As discussed above, the hitch pin 153*b* has a spring-loaded detent means 159*b*, which comprises a spring-loaded ball or sphere resiliently attached to the free end of the hitch pin. This detent means prevents the hitch pin from falling or slipping out of the apertures 158*b* and 157*b* after it is inserted in place. Thus, in order to insert and remove the hitch pin 153*b*, a force must be applied in the pin's axial direction. A chain 155*b* is attached to the other end of the hitch pin and is in turn attached to the frame 12*b* in order to prevent the hitch pin from being lost or misplaced.

Figure 9:
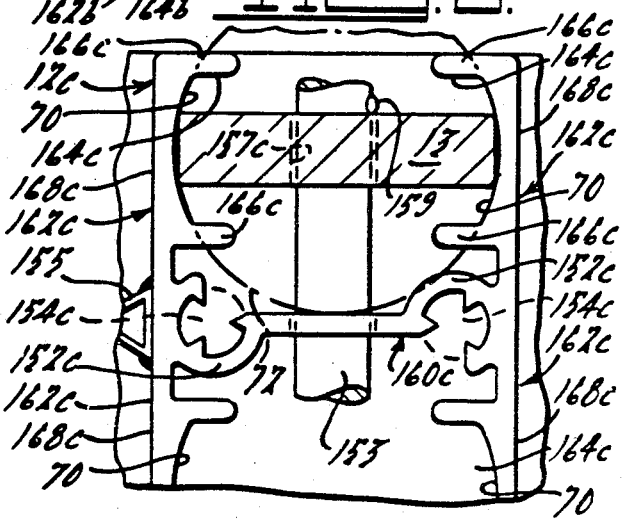
FIG. 9 is a cross-sectional view similar to that of FIG. 7, but illustrating still another embodiment of the sign and stand construction of FIG. 6.

Referring to FIG. 9, still another alternate preferred embodiment of the invention includes a stand frame 12*c*. In this embodiment, the means for allowing lateral pivotal or swing sign movement is provided by channels 164*c* formed by the channel legs 166*c* and the interconnecting channel bases 168*c*, which have generally arcuate frame-engaging surfaces 170. The spaces between the channel legs 166*c* are sufficiently wider than the thickness of the cross-brace 13 to allow the cross-brace to pivot or swing, as discussed above, about a generally vertical axis as illustrated in FIGS. 10 and 11. As is shown in FIG. 9, however, the corner edges of the cross-brace 13 frictionally engage the arcuate surfaces 170 of the channels 164*c* to frictionally retain the cross-brace 13 and thus the sign assembly in an attached relationship with the frame 12*c*. Thus, the sign assembly may be attached to the frame 12*c* merely by slidably and frictionally inserting the vertical cross-brace 13 into the channels 164*c* on either of the opposite sides of the frame 12*c* such that the cross-brace 13 is frictionally retained therein. Such frictional engagement of the cross-brace 13 and the channel 164*c* is maintained even when the sign assembly pivots laterally about the above-mentioned vertical axis. The hitch pin 153*c*, with its detent means 199*c* and chain 155*c* as discussed above, may also be employed in FIG. 9 in connection with the apertures 157*c* and 158*c*, if deemed desirable or advantageous in order to assure retention of the sign assembly.

When the sign assembly pivots or swings laterally about said generally vertical axis to a transverse orientation relative to side-directed winds, as discussed above in connection with the embodiment of FIG. 7, the second wind forces, such as 92 and 92*a*, have a force vector component exerted in a sufficiently transverse direction against the sign assembly such that the coil springs 16 may resiliently deflect the frames 12*b* and 12*c* along the above-described predetermined plate, as shown in FIG. 10. The width of the channels 164*b* and 164*c*, the distance between the channel bases 168*b* and 168*c*, and the spring constants of the coil spring, and other parameters are selected such that sufficient lateral pivotal movement of the sign assembly occurs to cause or allow the resultant deflection of the frame member to occur before the sign and stand assembly can tip over under the load of the second wind forces.

As was discussed above, the exact range of pivotal movement of the sign assembly depends upon several factors such as sign size and weight and coil spring constants, for example. However, a range of pivotal sign assembly movement through a total arc 96 (shown in FIG. 10) of approximately 10–35 degrees, and preferably approximately 15 degrees on either side of the normal sign orientation 80, has been found to provide satisfactory results. Either smaller or larger ranges of pivotal movement may also be sufficient to cause or allow the desired frame deflection, depending upon the particular physical conditions present and the particular application of the principles of the invention. It should be noted, however, that the arcuate surfaces 170 in FIG. 9 preferably both fall upon an imaginary circle 172 (shown in FIG. 9) which has a center located generally midway between the arcuate surfaces 170 and generally midway between the channel legs 166*c*. Such a configuration provides for the desired frictional engagement of the cross-brace 13 with the arcuate surfaces 170 while still allowing the requisite pivotal movement.

As shown and described above, the embodiments of the present invention shown in FIGS. 6 through 9 provide a sign stand having the capability of simple, quick and easy attachment and removal of sign assemblies on the sign frame. These embodiments also provide a sign attachment means that functions to minimize the possibility of the sign and stand assembly tipping over or sliding to undesired locations in high winds, no matter in which direction the forces of such winds are exerted.

The various parts of the sign and stand assembly embodiments of FIGS. 6 through 9 are preferably made of aluminum, but may also be made of any other lightweight materials that are strong enough to withstand the forces to which such signs are normally exposed in use. Furthermore, even though these embodiments described above are being used for flexible or roll-up sign panels of diamond shapes, it is apparent that they may be employed with a wide variety of sign panels of different materials, rigid or soft and with sign panels of widely varying sizes and shapes. With rigid sign panels, however, a flange or protruding member at least functionally similar to the vertical cross-brace 13 should be provided and should be adapted to be inserted as discussed above within the channels 164*a*, 164*b* or 164*c* on either of the opposite sides of the frames 12*a*, 12*b* or 12*c*, respectively. In the embodiment of FIG. 7, however, such a flange or protruding member should have sufficient resilience and flexibility to allow the above-described torsional twisting of its unsecured portion. Also, in order to retain the compactness and relatively small size of these embodiments of the invention for storage and transportation, the rigid signs should also be collapsible or foldable.

FIGS. 12 and 13 illustrate the preferred snap-type fastener device, indicated generally by reference numeral 200, for mounting the sign panel 10 to the cross-brace 11. The snap-type fastener 200 generally includes a male portion 202 having a head member 204 with a post member 206 portruding therefrom. The post member 206 preferably extends through an opening in a flexible strap 210, which is preferably secured to a corner portion of the sign panel 10, and thus the head member 204 is secured to the flexible strap itself.

The snap-type fastener 200 also includes a female portion 212 having a flange member 214 with a socket member 216 thereon. Preferably, the flange member 214 is secured to the rearward side 220 of the cross-brace 11 so that when the flexible strap 210 is bent or folded around the cross-brace 11, the post member 206 may be interlockingly but releasably inserted into the socket member 216 in order to attach the strap member 210 and the sign panel 10 to the cross-brace 11. It should be noted that although the arrangement shown in FIGS. 12 and 13 is preferred, the male portion 202 could alternatively be secured to the cross-brace 11, and correspondingly the female portion 212 could be secured to the strap member 210.

As shown in FIG. 13, when the sign assembly is subjected to winds having at least a portion of their forces directed as illustrated by reference numeral 91, such winds tend to separate the sign panel 10 from its cross-braces. Because the male and female portions 202 and 212 are mutually engaged on the rearward side of the cross-brace 11, such winds thereby subject the snap-type fastener 200 to a shear-type loading such as that illustrated by force vectors 230 and 232 in FIG. 13. The snap-type fastener 200 has a stronger resistance to separation of its male and female portion when subjected to such shear-type loading than to the so-called "peel-type" separation shown schematically in FIG. 14. Also, the snap-type fastener 200, being disposed for engagement on the rearward side of the cross-brace 11, provides a higher resistance to detachment of the sign panel 10 from its cross-brace, than it would have if it had been disposed for such engagement on the frontward side of the cross-brace where it would be subjected to peel-type separation. Furthermore, because the sign panel 10 is disposed on the frontward side of the cross-braces, winds having force vectors as illustrated by reference numeral 91*a* tend to urge the sign panel toward the cross-braces and thus do not tend to separate the male and female portions of the snap-type fasteners 200. Accordingly the present invention, as shown in FIGS. 12 and 13, allows the use of conventional snap-type fasteners 200 to securely retain the sign panel 10 on the cross-brace 11 in high wind conditions.

It should be noted that although a pair of snap-type fasteners 200 are shown for purposes of illustration in FIGS. 12 and 13, one or more of such fasteners may be employed in a given application. The number of fasteners depends upon the weights of the various components of the sign assembly, the wind conditions expected, the size and strength of the particular snap-type fasteners used, and other factors readily determinable by one skilled in the art. It should also be noted that the snap-type fasteners may also be adapted for attaching the sign panel 10 to the vertical cross-brace 13.

FIGS. 15 and 16 illustrate an alternate means for attaching or mounting the sign panel 10 to either or both of the cross-braces 11 and 13. A conventional hook-and-loop fastener 240 includes a hook portion 242 secured to the strap member 210 and a loop portion 244 secured to the rearward side of the cross-brace 11. The hook-and-loop fastener arrangement is similar to that of the snap-type fastener arrangement of FIGS. 12 and 13 such that the hook portion 242 and the loop portion 244 are mutually and releasably engagable with one another on the rearward side of the cross-brace. Thus, winds having force vectors such as 91 subject the hook-and-loop fastener 240 to shear-type loading as illustrated by force vectors 230 and 232 in FIG. 16.

Also like the snap-type fastener 200, the hook-and-loop fastener 240 is more capable of resisting shear loads than the peel-type separation shown schematically in FIG. 17. The hook-and-loop fastener 240, being disposed for engagement on the rearward side of the cross-brace 11, provides a higher resistance to detachment of the sign panel 10 from its cross-braces than it would if it had been disposed for such engagement on the frontward side of the cross-braces where it would be subjected to peel-type separation. It should be noted that in this alternate embodiment such hook-and-loop fasteners may also be adapted for attaching the sign panel 10 to the vertical cross-brace 13.

Alternate embodiments featuring hook-and-loop type fasteners (e.g. Velcro fasteners) are shown in FIGS. 18–21. The sign panel 300 is a collapsible vinyl-like material and has a horizontally-oriented cross-member 302 and a vertically-oriented cross-member 304. The cross-members 302 and 304 are pivoted together at point 306 and at least one cross-member is detachably secured at its ends to the sign panel. In this manner, when the sign is detached from one of the cross-members, the two cross-members can be rotated to a common position overlying one another and the sign panel can be wrapped or rolled-up around the cross-members into a smaller bundle for storage and transportation.

Each of the ends 308 and 310 of the cross-member 302 are attached to the sign by a pair of hook-and-loop fasteners. As discussed above, hook-and-loop fasteners have two parts, a first part having a plurality of tiny loops and a second part having a plurality of tiny hooks. When the hooks and loops are pressed together they form a secure attachment. One of the fasteners at the corners of the sign has one of the hook-and-loop parts 312 attached to the sign panel 300 and the other of the hook-and-loop parts 314 attached to the rear face of the cross-member 302. The second fastener 316 is attached to the sign panel 300 at approximately the same position as part 312 and has one of the hook-and-loop parts 318 at one end and the other hook-and-loop part 320 at the other end.

When the sign 300 is attached to the cross-member 302, hook-and-loop part 312 is first wrapped around the end of the cross-member and secured in place onto its mating hook-and-loop part 314. Then, the second hook-and-loop fastener 316 is wrapped around the cross-member and the first mated fastener (312, 314), and the hook-and-loop parts 318 and 320 are secured in place. The presence of the second hook-and-loop type fastener 316 at the ends of the cross-member insures that the sign panel cannot involuntarily be detached from the cross-member regardless of the weather conditions or applied forces to the connection.

In order to insure that the hook-and-loop parts 312 do not slip off the ends 308 and 310 of the cross-member, plastic caps 322 and 324 are positioned on the ends 308 and 310. Each of the caps 322 and 324 has a shallow groove 326 which is used to locate the part 312 and hold it in position around the end of the cross-member. (The best illustration of the use of the cap members to locate and position part of a hook-and-loop fastener is shown in FIG. 21.)

It is possible to have a pair of hook-and-loop fasteners at one, two, three or all of the corners of the sign. Only two fasteners are shown in FIGS. 18–21 (both on the horizontal cross-member), but it is understood that similar fasteners on the ends of vertically-oriented cross-member 304 can also (or alternatively) be provided. In this regard, if a cap is utilized on the lower end 305 of the cross-member 304, the cap should be made as small as possible so that it will not interfere with the insertion and attachment of the sign to a frame or sign stand, such as the frame 12*a* described above with reference to FIGS. 6–9.

Other hook-and-loop type fasteners can also be provided to assist in holding the sign panel tightly to the cross-members. A pair of hook-and-loop fasteners 330 and 332 are provided in the central area of the sign panel 300 in the embodiments shown in FIGS. 18 and 19. Once the cross-members 302 and 304 are rotated and secured in place at the corners of the sign, the fasteners 330 and 332, which are secured to the sign panel 300, are positioned around the cross-member 304. These additional fasteners keep the sign from billowing out or flapping in high winds. Also, it is to be understood that additional fasteners can be utilized to secure the center section of the sign panel more securely to either of the cross-members.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. In a sign assembly including a sign panel and at least one support member for supporting said panel in a generally planar configuration, the improvement comprising mounting means for releasably mounting said sign panel on said support member, said mounting means including a first strap member secured to said sign panel and being positionable over at least a portion of said support member, said first strap member being secured to said sign panel at a generally peripheral portion thereof and generally disposed on a first side of said support member, said first strap member being situated around an end portion of said support member for attachment to a second side of said support member, first releasable fastener means for releasably attaching said first strap member to said support member, said first fastener means being subjected primarily to shear loading when said sign panel is subjected to wind forces exerted generally in a direction such that said wind forces tend to separate said sign panel from said support member, a second strap member having two ends and secured to the sign panel, and second releasable fastening means for releasably connecting together the two ends of the second strap member around said support members.

2. The improvement according to claim 1, wherein said second strap member is secured to said sign panel in a position to wrap around said first strap member.

3. The improvement according to claim 1, wherein said first releasable fastener means comprises snap-type fastener means, said snap-type fastener means including a male portion and a female portion, said male and female portions being mutually and releasably engagable with one another in an interlocking relationship, one of said portions being secured to said first strap member and the other of said portions being secured to said support member.

4. The improvement according to claim 3, wherein said male portion is secured to said first strap member and said female portion is secured to said support member.

5. The improvement according to claim 1, wherein said first releasable fastener means comprises hook-and-loop fastener means, said hook-and-loop fastener means including a hook fastener portion and a loop fastener portion mutually releasably engagable with one another, one of said fastener portions being secured to said first strap member and the other of said fastener portions being secured to said support member.

6. The improvement according to claim 1, wherein said second releasable fastener means comprises hook-and-loop fastener means.

7. The improvement according to claim 1, further comprising third releasable fastening means positioned on said sign panel and releasably attaching said sign panel to said support member.

8. In a sign assembly including a sign panel and at least one support member for supporting said panel in a generally planar configuration, the improvement comprising mounting means for releasably mounting said sign panel on said support member, said mounting means including a first strap member secured to said sign panel and being positionable over at least a portion of said support member and first releasable fastener means for releasably attaching said first strap member to said support member, said first strap member being secured to said sign panel at a generally peripheral portion thereof and generally disposed on a first side of said support member, said first strap member being positioned around an end portion of said support member for attachment to a second side of said support member, said first releasable fastener having engageable portions disposed on said first strap member and on said support member, and a second strap member secured to said sign panel in a position to wrap around said support member and contact said first strap member, said second strap member having secured releasable fastener means thereon for securing said second strap member in place after it has been wrapped around said support member.

9. The improvement according to claim 8, wherein said first releasable fastener means comprises snap-type fastener means, said snap-type fastener means including a male portion and a female portion, said male and female portions being mutually and releasably engagable with one another in an interlocking relationship, one of said portions being secured to said first strap member and the other of said portions being secured to said support member.

10. The improvement according to claim 8, wherein said first releasable fastener means comprises hook-and-loop fastener means, said hook-and-loop fastener means including a hook fastener portion and a loop fastener portion mutally releasably engagable with one another, one of said fastener portions being secured to said first strap member and the other of said fastener portions being secured to said support member.

11. The improvement according to claim 10, wherein said first releasable fastener means and said second releasable fastener means each comprise hook-and-loop fastener means.

12. The improvement according to claim 8 further comprising third releasable fastener means positioned on said sign panel and releasably attaching said sign panel to said support member.

13. A sign assembly for display on a sign stand, the sign assembly having a generally diamond-shaped flexible sign panel and a pair of elongated supporting cross-members secured to a first side of the sign panel, the cross-members forming a generally "T" shaped configuration and being secured to the sign panel at each of their two ends, the improvement comprising fastening means for releasably securing the ends of at least one cross-member to the sign panel, said fastening means comprising a pair of first strap members attached to the sign panel and extending around the ends of the cross-member and being secured to the rear face of the cross-member by hook-and-loop type fasteners, and a pair of second strap members attached to the sign panels and positioned to wrap around the cross-member and contact said first strap member adjacent the rear face of the cross-member, said second strap member being secured in the wrapped around position by hook-and-loop type fasteners.

14. A sign assembly as set forth in claim 13 further comprising second fastening means similar to said first fastening means for releasably securing the ends of the second cross-member to the sign panel.

15. A sign assembly as set forth in claim 13 further comprising third fastening means for securing at least one of said cross-members to the sign panel at a position immediate the ends of said cross-member, said third fastening means comprising a strap member secured to said sign panel and positioned to wrap around said cross-member and fasten in place by hook-and-loop type fasteners.

* * * * *

UNITED STATES PATENT AND TRADEMARK OFFICE

CERTIFICATE OF CORRECTION

PATENT NO. :4,592,158

DATED :June 3, 1986

INVENTOR(S) : James R. Seely

It is certified that error appears in the above-identified patent and that said Letters Patent is hereby corrected as shown below:

| | |
|---|---|
| Column 5, line 23 | "Section" should be --section--. |
| Column 6, line 37 | "46" should be --56--. |
| Column 10, line 18 | "channel" should be --channels--. (second occurrence) |
| Column 13, line 51 | "plate" should be --plane--. |
| Column 17, line 49 | "engagable" should be --engageable--. |
| Column 17, line 62 | "engagable" should be --engageable--. |
| Column 18, line 33 | "engagable" should be --engageable--. |

UNITED STATES PATENT AND TRADEMARK OFFICE

CERTIFICATE OF CORRECTION

PATENT NO. : 4,592,158

DATED : June 3, 1986

INVENTOR(S) : James R. Seely

It is certified that error appears in the above-identified patent and that said Letters Patent is hereby corrected as shown below:

| | | |
|---|---|---|
| Column 18, | line 42 | "mutally" should be --mutually--. |
| Column 18, | line 42 | "engagable" should be --engageable--. |

Signed and Sealed this

Seventeenth Day of March, 1987

*Attest:*

DONALD J. QUIGG

*Attesting Officer*

*Commissioner of Patents and Trademarks*